US009815113B2

(12) United States Patent
Tang et al.

(10) Patent No.: US 9,815,113 B2
(45) Date of Patent: Nov. 14, 2017

(54) REFRACTORY SUBMERGED ENTRY NOZZLE

(71) Applicant: REFRACTORY INTELLECTUAL PROPERTY GMBH & CO. KG, Vienna (AT)

(72) Inventors: Yong Tang, Leoben (AT); Gerald Nitzl, Baden (AT)

(73) Assignee: REFRACTORY INTELLECTUAL PROPERTY GMBH & CO. KG, Vienna (AT)

( * ) Notice: Subject to any disclaimer, the term of this patent is extended or adjusted under 35 U.S.C. 154(b) by 62 days.

(21) Appl. No.: 14/889,284

(22) PCT Filed: Apr. 15, 2014

(86) PCT No.: PCT/EP2014/057666
§ 371 (c)(1),
(2) Date: Nov. 11, 2015

(87) PCT Pub. No.: WO2014/202257
PCT Pub. Date: Dec. 24, 2014

(65) Prior Publication Data

US 2016/0082509 A1 Mar. 24, 2016

(30) Foreign Application Priority Data

Jun. 20, 2013 (EP) ..... 13173091

(51) Int. Cl.
*B22D 41/50* (2006.01)
*B22D 11/10* (2006.01)

(52) U.S. Cl.
CPC ..... *B22D 41/50* (2013.01); *B22D 11/10* (2013.01)

(58) Field of Classification Search
CPC ..... B22D 41/50
USPC ..... 222/606, 607
See application file for complete search history.

(56) References Cited

U.S. PATENT DOCUMENTS

| | | | | |
|---|---|---|---|---|
| 3,991,815 | A | 11/1976 | Fastner | |
| 2011/0233237 | A1* | 9/2011 | Gernot | B22D 41/50 222/566 |
| 2012/0248157 | A1* | 10/2012 | Kuroda | B22D 41/50 222/591 |

FOREIGN PATENT DOCUMENTS

| | | | |
|---|---|---|---|
| EP | 1541258 | A1 | 6/2005 |
| EP | 2226141 | B1 | 10/2012 |
| JP | H09271910 | A | 10/1997 |
| KR | 20020000910 | A | 1/2002 |

OTHER PUBLICATIONS

International Search Report for App. No. PCT/EP2014/057666 dated Jan. 23, 2015.

* cited by examiner

*Primary Examiner* — Scott Kastler
(74) *Attorney, Agent, or Firm* — Medley, Behrens & Lewis, LLC

(57) ABSTRACT

The invention relates to a refractory submerged entry nozzle (also called SEN or casting nozzle) especially but not limited for use in a continuous casting process for producing steel.

10 Claims, 6 Drawing Sheets

REFRACTORY SUBMERGED ENTRY NOZZLE

Figure 1:
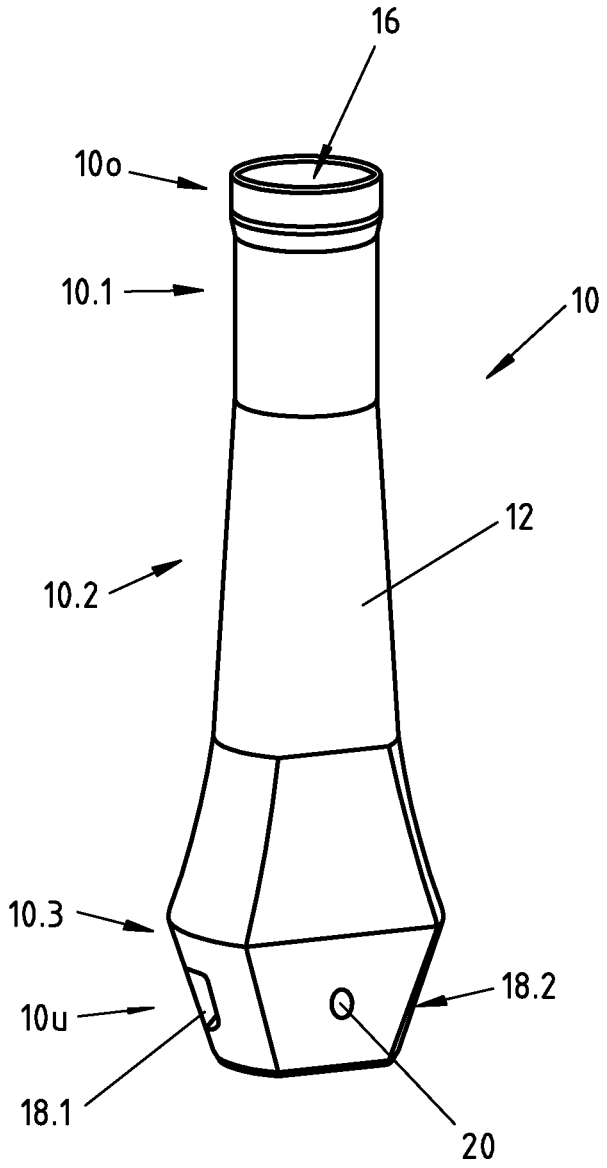

The invention relates to a refractory submerged entry nozzle (also called SEN or casting nozzle) especially but not limited for use in a continuous casting process for producing steel.

During such casting the molten metal is transferred from a so called ladle (German: Pfanne) into a tundish (German: Verteiler) and from there via corresponding tundish-outlets into associated moulds.

The melt transfer from the tundish into a mould is achieved by a generic SEN, which is arranged in a vertical use position and which typically provides the following features:

a generally tube like shape comprising a nozzle wall surrounding a flow through channel which extends between an inlet opening at a first nozzle end, being an upper end in a use position of the nozzle, and at least one lateral outlet opening at a second nozzle end, being a lower end in the use position, to allow a continuous flow stream of a molten metal from said ladle along said flow through channel from its inlet opening through the outlet opening into an associated molten metal bath in said mould.

To improve the general performance of such a nozzle EP 2226141 B1 discloses a nozzle with a perturbation in the form of a recessed channel in the inner surface of the nozzle wall of at least one outlet opening so as to produce a fluid flow which follows the shape of the lateral outlet openings.

U.S. Pat. No. 3,991,815 A discloses a nozzle design to improve a controlled flow at a separate bottom opening beneath the lateral outlet openings. This is achieved in that the casting tube has a converging/diverging end section with at least two outlet openings above said necking.

Both designs do not consider the following casting problem: After leaving the two lateral outlet openings the molten metal stream causes turbulences in the molten metal bath within the mould. To the contrary: there is nearly no flow velocity in the molten metal bath between the nozzle and the adjacent mould wall sections opposite to the "closed" nozzle walls, i.e. that nozzle area with no outlet opening.

A certain flow in the mould is important to prevent the formation of a top crust, caused by the so called mould flux (German: Schlackenpulver), which mould flux has the task to lubricate the inner surfaces of the mould to prevent the metal melt from sticking to the wall and solidifying in an uncontrolled manner.

An excessive flow in the mould has the disadvantage of uneven temperature distribution in the mould and poor lubrication properties of the mould flux.

Therefore it is an object of the invention to reduce the difference of the conditions within the mould around the submerged nozzle.

The invention is based on the finding that this can be achieved by a change in the design of the nozzle.

According to prior art a generic nozzle has at least one, often two lateral outlet openings (EP2226141B1) and sometimes two lateral and one bottom outlet openings (U.S. Pat. No. 3,991,815 A). All designs are based on the idea to influence the flow of the melt stream on its way leaving the nozzle.

This gridlocked idea is now overcome by the invention providing a submerged nozzle with at least one intake port besides the various outlet openings, i.e. at least one opening via which the metal melt of the metal melt bath within the mould may enter the interior (the flow through channel) of the nozzle.

In other words: The invention is based on the concept to add at least one further melt stream (from the melt bath within the mould) to the existing melt stream (which directly comes from un upstream vessel like a ladle), thereby achieving the following effect:

The melt stream sucked in by the intake port and flowing through said intake port into the main flow through channel causes an unexpected (indirect) additional melt flow in the molten metal bath within the mould and thus an additional melt velocity and melt turbulences.

To use this effect in a favorable manner the intake port is placed along that side of the nozzle, facing the molten melt bath with the lowest (mostly insufficient) flow velocity (turbulences) to improve the melt circulation in that area accordingly.

In view of the aforesaid: in a nozzle with two lateral outlet openings (and optional one further bottom outlet) the intake port is preferably arranged just between these opposed lateral outlet openings.

At the same time this additional melt stream influences the melt flow in the area directly following the outlet openings in a favorable manner.

It is obvious that the melt, sucked in by the intake port(s) in one or more additional streams merges with the main melt stream within the nozzle on its/their further way downwardly towards the outlet opening(s) and then leaves the nozzle via said outlet openings.

In its most general embodiment the invention refers to a refractory submerged entry nozzle providing the following features:

- a generally tube like shape comprising a nozzle wall surrounding a flow through channel which extends between an inlet opening at a first nozzle end, being an upper end in a use position of the nozzle, and at least one outlet opening at a second nozzle end, being a lower end in the use position, to allow a continuous flow stream of a molten metal along said flow through channel from its inlet opening through the outlet opening into an associated molten metal bath,
- at least one intake port being arranged between the at least one outlet opening and the said inlet opening within the nozzle wall in an section of said wall being submerged in the molten metal bath when the nozzle is in its use position, to allow molten metal of the molten metal bath to penetrate via said intake port into the flow through channel.

The arrangement of the at least one intake port includes the whole area of the existing outlet opening(s), i. e. the whole axial length of these openings. In other words: The intake port may be arranged at any place between the lowermost end of any said outlet openings and the inlet opening with the proviso of being submerged in the metal bath during casting. Typically the placement within the lower third or lower fourth of the nozzle is preferred, i. e. in the area of the said outlet openings.

The at least one intake port may be provided by an opening extending from an outer surface to an inner surface of the nozzle wall.

Whereas the shape of this intake port is more or less arbitrary at least one of the following cross sections is possible: circle, oval, triangle, rectangle.

The size (cross sectional area) of the suction port depends on the desired suction effect. In case of a circular opening a typical diameter is between 5 and 50 mm and correspondingly suitable cross sectional areas may be calculated for non-circular designs.

The intake port may extend more or less horizontally (in the use position of the nozzle) or with an inclination towards the lower end of the nozzle, i.e. in the flow direction of the melt stream.

A nozzle with at least two intake ports arranged at opposite sides of the nozzle describes one further embodiment which is suitable in particular with a general nozzle design as disclosed in FIG. 1 of EP 2226141 B1 and further described hereinafter with reference to the drawing.

In case of a nozzle with two (opposed) lateral outlet openings, the at least one intake port can be arranged in a wall area between the two outlet openings. The nozzle may have an outlet opening as well as its lowermost end (in the use position).

Independently of the number and shape of outlets, the at least one intake port (suction port) should be arranged beneath a casting level in the use position of the nozzle to ensure that only molten metal enters the port while the casting flux, ambient air etc. being excluded from entering the port.

In a nozzle design as disclosed in EP 2226141 B1 the tube like shape comprises at least three sections, namely:

- an upper section, including the inlet opening and having a substantially circular cross-section,
- a middle section which is flared outwardly in one first plane and flattened in a second plane, being perpendicular to the first plane,
- a lower section comprising the at least one outlet opening.

This design may be improved in accordance with the invention if the at least one intake port is provided and preferably arranged in the lower part of the middle section and/or in the upper part of the lower section.

This is true in particular if the two lateral outlet openings in the lower section are arranged opposite to each other.

In another embodiment the inventive nozzle (according to claim 1) is characterized by the following features:

at least one intake port is arranged between two protrusions arranged at a distance to each other on opposite sides of the intake port in an axial direction of the nozzle and along the same inner surface of the nozzle wall. This embodiment is shown in attached FIG. 2-4.

In other words: The two protrusions are discrete profiles providing a kind of a gap in between. The intake port merges into this gap. The central melt stream, flowing substantially vertically downwards, is guided along this gap, accelerated and providing a backpressure, namely a low pressure (partial vacuum) in the space defined by said intake port, causing the molten melt outside the nozzle to enter the intake port and to flow towards and into the main metal stream along the flow channel.

This effect can be improved if the distance between said two protrusions becomes smaller between their upper and lower ends.

This effect can further be improved if said two protrusions are arranged in such a way as to provide a Venturi nozzle between them, i.e. a converging upper and a diverging lower part and a necking portion therebetween.

This effect can still further be improved if the smallest distance ($d_{min}$) between the two protrusions is adjacent to the intake port.

By varying these features as well as the size of the intake port it is possible to adjust the flow (speed) of the entrained metal melt in the desired way and to the desired amount.

Reference is made to the further embodiments disclosed in the Figures, features of which are not limited to the specific design but may also be realized in equivalent or similar nozzle designs.

Further features of the invention derive from the features of the sub-claims and the other application documents.

The invention will now be described in more details with respect to the attached drawing schematically representing possible embodiments of the invention, namely:

FIG. 1: A perspective view onto a first embodiment of a refractory submerged entry nozzle (SEN) according to the invention, FIG. 2: The SEN according to FIG. 1 in a longitudinal sectional view in its functional position within a tundish.

Figure 2:
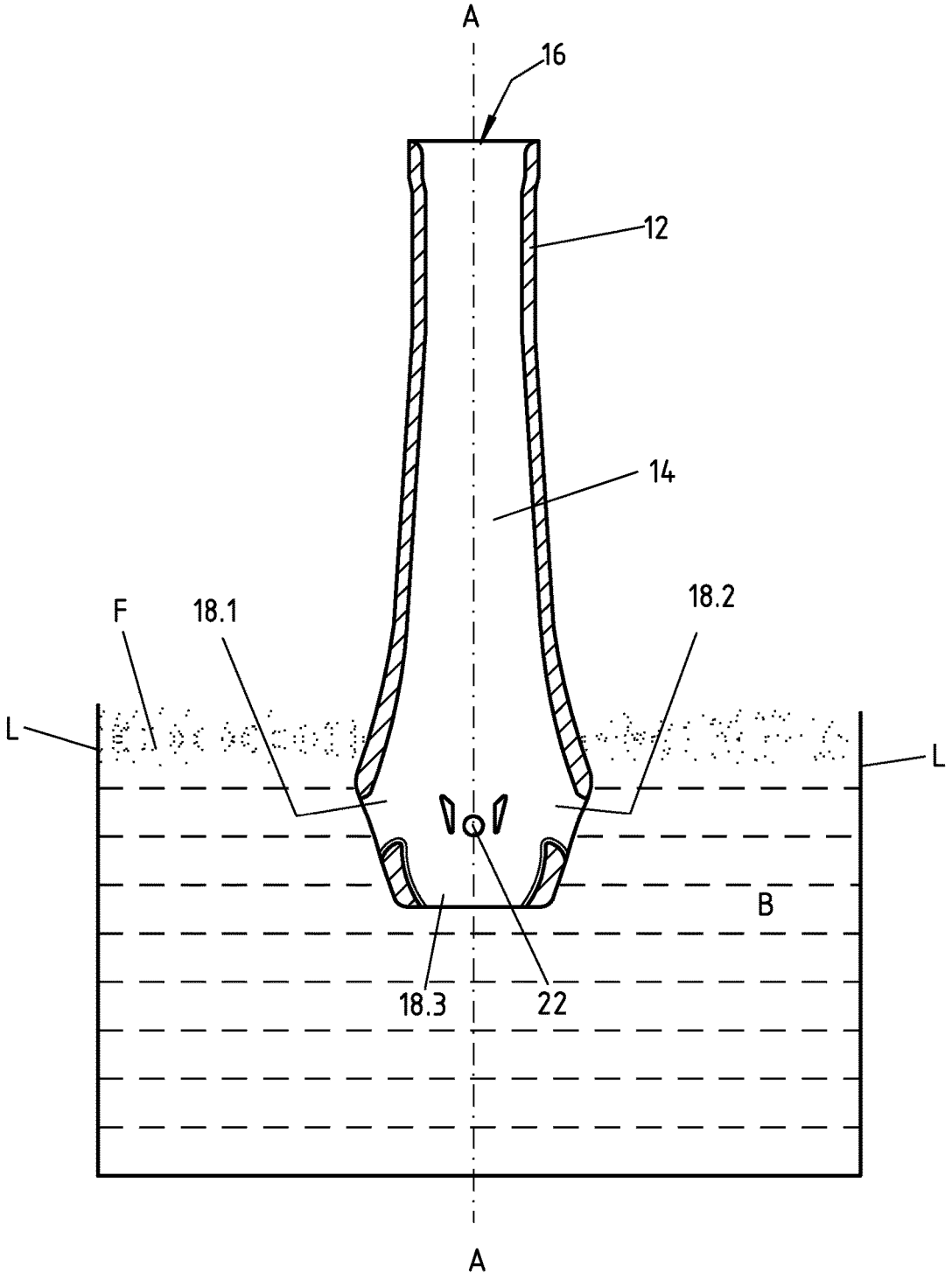
Figure 3:
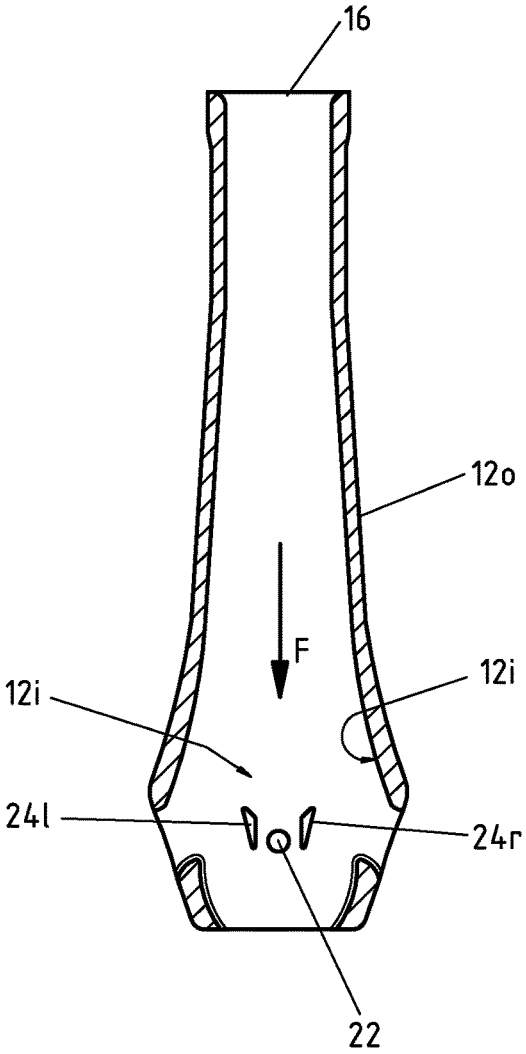

FIG. 3: The SEN according to FIG. 2 in an enlarged scale.

Figure 4:
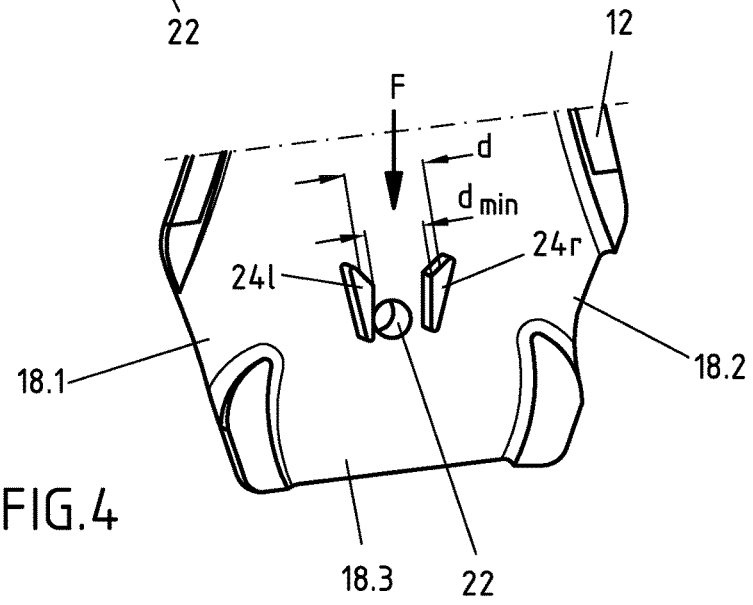

FIG. 4: An enlarged view onto one intake port of the SEN according to FIGS. 2, 3.

Figure 5:
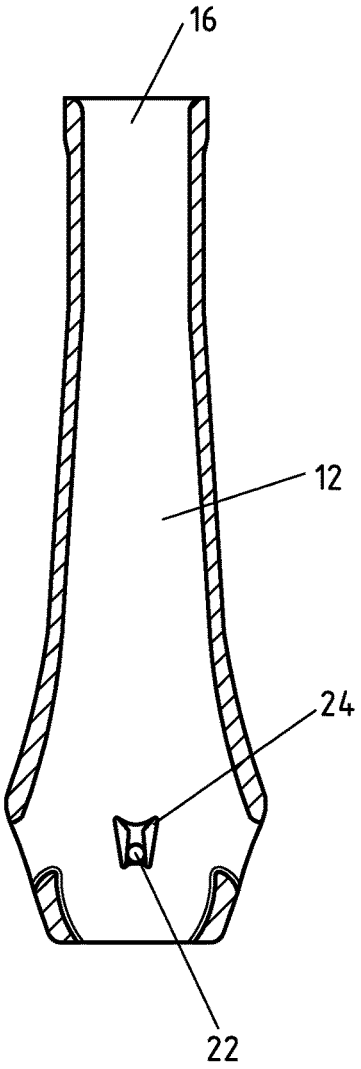

FIG. 5: A view according to FIG. 3 for a second embodiment.

Figure 6:
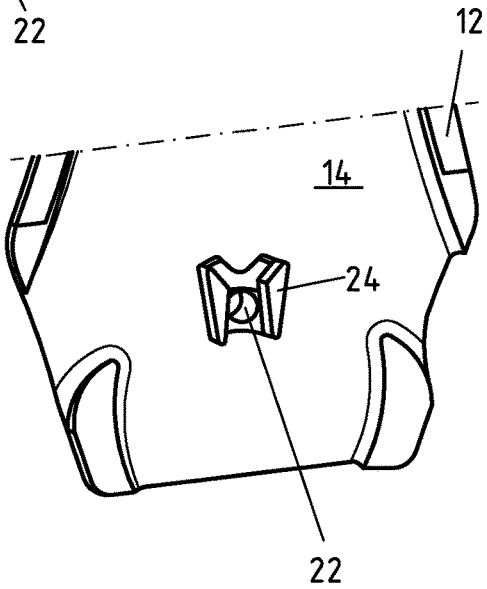

FIG. 6: A view according to FIG. 4 for the second embodiment.

Figure 7:
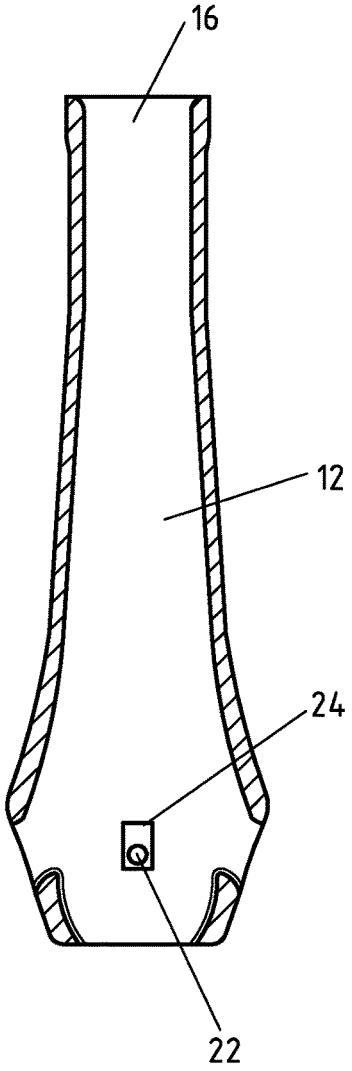

FIG. 7: A view according to FIG. 3 for a third embodiment.

Figure 8:
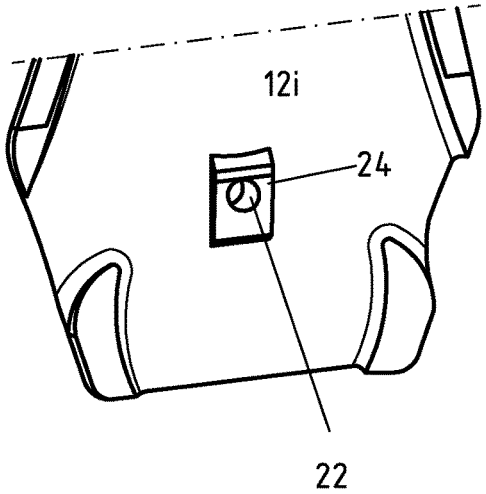

FIG. 8: A view according to FIG. 4 for the third embodiment.

Figure 9:
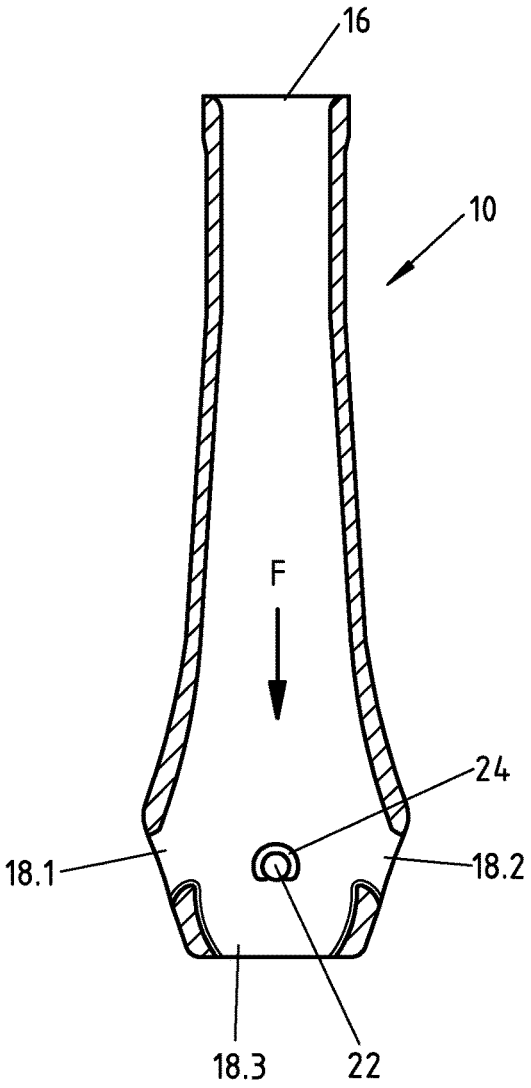

FIG. 9: A view according to FIG. 3 for a fourth embodiment.

Figure 10:
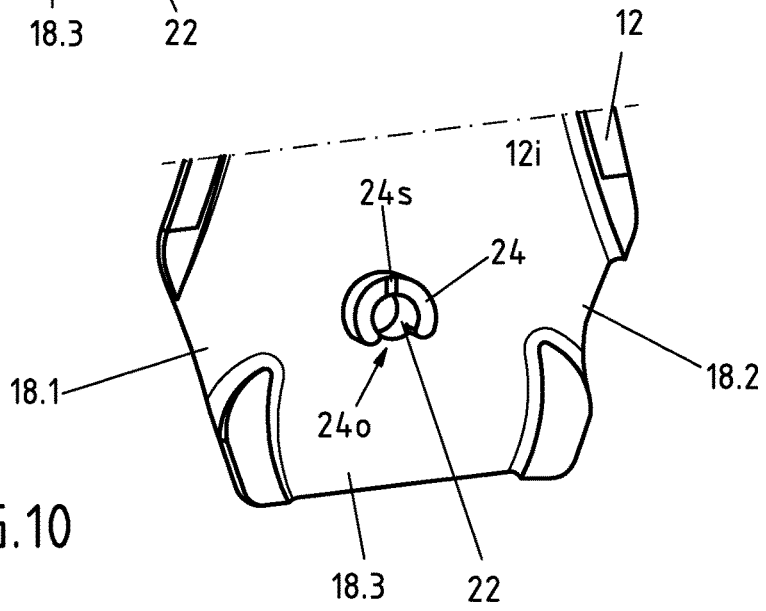

FIG. 10: A view according to FIG. 4 for the fourth embodiment.

In the Figures functionally identical or similar construction details are characterized by the same numerals.

FIG. 1 is a perspective view onto a submerged refractory entry nozzle (SEN) according to the invention. It has a generally tube-like shape, comprising a nozzle wall 12, surrounding a flow through channel 14 (FIG. 2) which extends between an inlet opening 16 at a first nozzle end 10*o*, being an upper end in the use position of the nozzle (FIG. 2) and two lateral outlet openings 18.1, 18.2 at a second nozzle end 10*u*, being a lower end in the use position. This design allows a continuous flow stream of a molten metal from the inlet opening 16 along the flow through channel 14 downwardly and through the outlet openings 18.1, 18.2 into an associated molten metal bath B (FIG. 2).

The SEN further comprises two intake ports 20, 22 being arranged between the outlet openings 18.1, 18.2 and the inlet opening 16 within the nozzle wall 12 within a section of said nozzle wall 12, which is submerged in the molten metal bath B when the nozzle 10 is in its use position (FIG. 2) to allow molten metal of the molten metal bath (B) to penetrate via said take intake ports 20, 22 into the flow through channel 14 and further leaving the flow through channel 14 via outlet ports 18.1, 18.2 and/or a third outlet opening 18.3 at the lowermost end of nozzle 10.

FIG. 2 further represents a mould flux F on top of the melt bath B, defining a casting level L-L.

As may best be derived from FIGS. 2-4 intake ports 20, 22 are arranged along a height of the adjacent lateral outlet openings 18.1, 18.2 (seen in an axial direction A-A of nozzle 10, i. e. in flow direction of the melt through the nozzle).

Each intake port 20, 22 is provided by an opening extending from an outer surface 12*o* to an inner surface 12*i* of the nozzle wall 12 wherein said opening has a circular cross section.

In other words: The intake ports 20, 22 are arranged in a wall area between the two outlet openings 18.1, 18.2 and within a more or less planar wall section between the said two outlet openings 18.1, 18.2 (FIG. 1).

In the embodiment described in FIGS. 1-4 the overall nozzle is characterized by an upper section 10.1, including the outlet opening 16, which upper section has a substantially circular cross section. It is further characterized by a middle section 10.2, which is flared outwardly in one first plane and flattened in a second plane, being perpendicular to the first plane. It further comprises a lower section 10.3, comprising the outlet openings 18.1, 18.2, 18.3 and the intake ports 20, 22. The intake ports 20, 22 are arranged in the lower fourth (fifth) of the axial length of the nozzle.

Each of said intake ports 20, 22 is arranged between two protrusions 24*l*, 24*r*, arranged at a distance to each other on opposite sides of the respective intake port (22 in FIG. 3) and in the axial direction of the nozzle as well as along the same inner surface 12*i* of the nozzle wall 12.

These protrusions 24*l*, 24*r* provide a gap in between, in which gap the said intake port 20, 22 is arranged. The intake port 20, 22 merges into this gap. Consequently, the central melt stream, flowing substantially vertically downwards (FIG. 3 arrow F) is guided along this gap (on the inner side of surface 12*i*) accelerated and providing a back pressure, namely a low pressure (partial vacuum) in the space around said intake port. This causes the molten melt within the melt bath B to enter the intake port 20, 22 and to flow through said intake port 20, 22 into the main melt stream (within flow through channel 14). At the same time the metal melt bath on the respective side of nozzle 10 is set into motion, while further metal melt is flowing through said intake port into the nozzle.

The protrusions 24*l*, 24*r* according to the embodiment of FIGS. 1 to 4 have a triangular profile (in a view according to FIG. 4, thus providing a kind of a Venturi nozzle, which further increases the melt velocity, passing the gap between said two protrusions 24*l*, 24*r* in a downward direction (arrow F in FIGS. 3, 4).

The Venturi design is characterized in that width d of the gap between opposed protrusions 24*l*, 24*r* gets smaller in the upper part and larger in the lower part, with $d_{min}$ in-between wherein intake port 22 is arranged between the lower parts of said protrusions 24*l*, 24*r*.

The embodiments of FIGS. 5 to 10 differ from the embodiment of FIGS. 1 to 4 only with respect to the design of the said protrusion(s).

The example of FIGS. 5, 6 discloses a funnel shaped monolithic protrusion 24, i. e. the lower part of said protrusion 24 covers the corresponding intake port 22 partially and with a distance to the inner end of said intake port 22.

The embodiment according to FIGS. 7, 8 is characterized by a box-like protrusion 24, which allows the intake port 22 to become longer such that the corresponding melt stream flowing into nozzle 10, enters the flow through channel 14 at a distance to said inner nozzle wall 12*i*.

The embodiment according to FIGS. 9, 10 is similar to that of FIGS. 7, 8 with the proviso that said box-like protrusion has an opening 24*o* at its lower end and a slit 24*s* at its upper end to allow the main stream of the metal melt to pass said intake port 22 after passing slit 24*s* and before passing opening 24*o*.

The invention claimed is:

1. Refractory submerged entry nozzle providing the following features:

a nozzle wall (12) surrounding a flow through channel (14) which extends between an inlet opening (16) at a first nozzle end (100), being an upper end in a use position of the nozzle, and at least one outlet opening (18.1, 18.2, 18.3) at a second nozzle end (1 Ou), being a lower end in the use position, to allow a continuous flow stream of a molten metal along said flow through channel (14) from its inlet opening (16) through the outlet opening (18.1, 18.2) into an associated molten metal bath (B), at least one intake port (20, 22) being arranged between the at least one outlet opening (18.1, 18.2, 18.3) and the said inlet opening (16) within the nozzle wall (12) in a section of said wall (12) being submerged in the molten metal bath (B) when the nozzle is in its use position, wherein at least one intake port (20, 22) is arranged between two protrusions (24*l*, 24*r*) arranged at a distance to each other on opposite sides of the intake port (20, 22) in an axial direction of the nozzle and along a common inner surface of the nozzle wall (12), to allow molten metal of the molten metal bath to penetrate via said intake port (20, 22) into the flow through channel (14).

2. Nozzle according to claim 1, wherein the at least one intake port (20, 22) is provided by an opening extending from an outer surface (120) to an inner surface (12*i*) of the nozzle wall (12), wherein the said opening has one of the following cross sections: circle, oval, triangle, rectangle.

3. Nozzle according to claim 1 with at least two intake ports (20, 22) arranged at opposite sides of the nozzle.

4. Nozzle according to claim 1 with two lateral outlet openings (18.1, 18.2), wherein the at least one intake port (20, 22) is arranged in a wall area between the two outlet openings (18.1, 18.2).

5. Nozzle according to claim 1, comprising at least three sections (10.1, 10.2, 10.3), namely:

an upper section (10.1), including the inlet opening (16) and having a substantially circular cross-section, a middle section (10.2) which is flared outwardly in one first plane and flattened in a second plane, being perpendicular to the first plane, a lower section (10.3) comprising the at least one outlet opening (18.1, 18.2, 18.3), wherein the at least one intake port (20, 22) is arranged in the lower part of the middle section (10.2) or the upper part of the lower section (10.3).

6. Nozzle according to claim 5 comprising two lateral outlet openings (18.1, 18.2) in the lower section (10.3), arranged opposite to each other.

7. Nozzle according to claim 1, wherein the distance (d) between said two protrusions (24*l*, 24*r*) becomes smaller between their upper and lower ends.

8. Nozzle according to claim 1, wherein said two protrusions (24*l*, 24*r*) are arranged in such a way as to provide a Venturi nozzle between them.

9. Nozzle according to claim 8, wherein the smallest distance ($d_{min}$) between the two protrusions (24*l*, 24*r*) is adjacent to the intake port (22).

10. Nozzle according to claim 1 with an outlet opening (18.3) extending at a lowermost end of the lower end of the nozzle.

* * * * *